US008671618B2

(12) United States Patent
Yingst et al.

(10) Patent No.: US 8,671,618 B2
(45) Date of Patent: Mar. 18, 2014

(54) PRODUCT SERVER WITH BREATH GUARD

(75) Inventors: Thomas E. Yingst, St. Louis, MO (US); Frederick A. Deluca, Ft. Lauderdale, FL (US)

(73) Assignee: Duke Manufacturing Co., St. Louis, MO (US)

( * ) Notice: Subject to any disclaimer, the term of this patent is extended or adjusted under 35 U.S.C. 154(b) by 400 days.

(21) Appl. No.: 13/099,519

(22) Filed: May 3, 2011

(65) Prior Publication Data

US 2011/0204755 A1 Aug. 25, 2011

Related U.S. Application Data

(60) Continuation of application No. 11/013,813, filed on Dec. 16, 2004, now Pat. No. 7,958,673, which is a division of application No. 10/662,783, filed on Sep. 15, 2003, now Pat. No. 7,640,696.

(51) Int. Cl.
*E05D 15/48* (2006.01)
*E05F 11/52* (2006.01)

(52) U.S. Cl.
USPC ..... 49/152; 49/381; 108/7; 312/139.1; 312/327; 186/38

(58) Field of Classification Search
USPC ..... 49/475.1–500.1, 152, 153, 246, 248, 49/249, 339, 345, 381; 108/7; 312/138.1, 312/139, 139.1, 140.4, 325, 327; 186/38, 186/40, 44
See application file for complete search history.

(56) References Cited

U.S. PATENT DOCUMENTS

| | | | | |
|---|---|---|---|---|
| 790,135 | A | | 5/1905 | Jaeger |
| 2,346,368 | A | | 4/1944 | Edwards |
| 2,518,134 | A | | 8/1950 | Fredenhagen |
| 2,886,395 | A | * | 5/1959 | Cahn ..... 312/279 |
| 3,499,245 | A | * | 3/1970 | Richter et al. ..... 49/70 |
| 3,631,630 | A | * | 1/1972 | Buffington et al. ..... 49/402 |
| 4,194,731 | A | | 3/1980 | Marx |
| 4,572,598 | A | | 2/1986 | Moore |
| 4,603,557 | A | | 8/1986 | Halbmann |
| 4,750,335 | A | | 6/1988 | Wallace |

(Continued)

FOREIGN PATENT DOCUMENTS

| | | | |
|---|---|---|---|
| JP | 07303548 | A | 11/1995 |
| JP | 08266421 | A | 10/1996 |

(Continued)

OTHER PUBLICATIONS

International Search Report dated Sep. 15, 2003, 3 pages.

(Continued)

*Primary Examiner* — Jeffrey Shapiro
(74) *Attorney, Agent, or Firm* — Senniger Powers LLP

(57) ABSTRACT

A product server for holding and displaying food products is disclosed. The product server has a front customer side, a rear employee side and a breath guard. The breath guard comprises a cover on a cabinet of the product server that is moveable between a lowered position covering the food products and a raised position in which the cover serves as a breath guard and allows access to the food products. Upright side panels are provided adjacent opposite ends of the product server. The breath guard extends between the upright side panels as it moves between its raised and lowered positions.

31 Claims, 11 Drawing Sheets

(56) References Cited

U.S. PATENT DOCUMENTS

| | | | | |
|---|---|---|---|---|
| 4,802,340 | A | 2/1989 | Johnson | |
| 4,842,349 | A | 6/1989 | Stenemann | |
| 5,112,118 | A | 5/1992 | Wiehle | |
| 5,116,274 | A | 5/1992 | Artwohl | |
| 5,168,719 | A * | 12/1992 | Branz et al. | 62/258 |
| 5,182,924 | A * | 2/1993 | Trulaske, Sr. | 62/255 |
| 5,207,490 | A | 5/1993 | Kaspar | |
| 5,618,089 | A | 4/1997 | Stenemann | |
| 5,797,593 | A | 8/1998 | Oyaizu | |
| 6,132,018 | A | 10/2000 | McGrath | |
| 6,385,990 | B1 | 5/2002 | Lee | |
| 6,467,294 | B1 | 10/2002 | Walker | |
| 6,547,346 | B2 | 4/2003 | Topper | |
| 2002/0043906 | A1 | 4/2002 | DeWitt | |
| 2002/0074906 | A1 * | 6/2002 | Topper et al. | 312/116 |

FOREIGN PATENT DOCUMENTS

| | | |
|---|---|---|
| NL | 6502319 | 8/1966 |
| WO | 0228235 | 4/2002 |
| WO | 2005027695 A2 | 3/2005 |

OTHER PUBLICATIONS

Statement of Thomas E. Yingst, 3 pages including Exhibit A, signed Oct. 1, 2004.

Decision on Appeal dated Sep. 29, 2010, regarding U.S. Appl. No. 11/013,813, 9 pages.

Decision on Request for Rehearing dated Jan. 21, 2011, regarding U.S. Appl. No. 11/013,813, 4 pages.

Supplementary European Search Report regarding EP 04783826.3, dated Dec. 18, 2006, 3 pages.

* cited by examiner

PRODUCT SERVER WITH BREATH GUARD

CROSS-REFERENCE TO RELATED APPLICATIONS

This application is a continuation of U.S. patent application Ser. No. 11/013,813 filed Dec. 16, 2004, which is a divisional of U.S. patent application Ser. No. 10/662,783, filed Sep. 15, 2003, which issued as U.S. Pat. No. 7,640,696 on Jan. 5, 2010. The entire text of U.S. patent application Ser. No. 11/013,813 and U.S. patent application Ser. No. 10/662,783 is incorporated herein by reference.

BACKGROUND OF THE INVENTION

The present invention relates generally to a product server for holding and displaying products, and more particularly to a product server having a moveable panel for controlling access to the server.

One such application for this invention is the storage and display of hot and cold food products. However, it is contemplated that other types of products may be stored and displayed in the product server. Existing product servers are common in restaurants where sandwiches or other food items are prepared by food service employees in the presence of a customer. Existing product servers are arranged to store hot and cold food products in pans on one side of the server that is readily accessible by the food server employees. These product servers allow employees to prepare a finished product (e.g., sandwich) on a counter of the server by using the different ingredients stored in the product server. Frequently, the sandwich or other food item will be made at the direction of the customer while the customer observes the food preparation process. It is important to the quality of the finished product that the ingredients held and displayed in the server remain fresh.

During extended periods of non-use, the food pans holding the different ingredients (e.g., meats, cheeses, vegetables or other condiments) must be individually covered so that the ingredients remain fresh. Some existing food server designs have a stainless steel cover that may be moved to cover the food pans. Reference may be made to U.S. Pat. No. 5,168,719 and U.S. Pat. No. 5,182,924, incorporated by reference herein for all purposes, for additional background information on food servers having such a cover. Other existing food servers have a fixed hood that restricts access to the food pans from the back of the server and acts as a breath guard that protects items in the food pan from contamination. Reference may be made to U.S. Pat. No. 4,802,340, incorporated by reference herein for all purposes, for additional background information on food servers of this type. A need exists for a product server that allows visual inspection of the products held in the server from the customer side and is easily closeable to protect the products from contamination.

SUMMARY OF THE INVENTION

In general, a product server of the present invention holds and displays food products. The product server has a front customer side and a rear employee side and includes a cabinet having a food preparation surface adjacent the employee side of the product server for the preparation of food orders. The server also includes a rectangular breath guard on the cabinet. The breath guard has a front, a back, and opposite sides and is pivoted adjacent its back adjacent the customer side of the product server for movement between a lowered generally horizontal position covering food products held by the product server and a raised position. The breath guard has a breath guard configuration such that when it is in its raised position it provides a barrier to contamination of the food products by customers on the customer side of the product server while allowing access to said food products by employees on the employee side of the product server. Upright side panels are provided at opposite sides of the breath guard. The breath guard extends between the upright side panels as it moves between its raised and lowered positions.

This invention is also directed to a food product server comprising a front customer side, a rear employee side, and a cabinet having a food preparation surface adjacent the employee side of the product server for the preparation of food orders. A rectangular breath guard on the cabinet is pivoted adjacent the customer side of the product server for movement between a lowered generally horizontal position covering food products held by the product server and a raised position. The breath guard has a breath guard configuration such that when it is in its raised position it provides a barrier to contamination of the food products by customers on the customer side of the product server while allowing access to food products by employees on the employee side of the product server. Upright side panels are provided adjacent opposite ends of the product server. The breath guard extends between the upright side panels as it moves between its raised and lowered positions. The breath guard comprises a breath guard panel that lies in a generally horizontal plane when the breath guard is in its lowered position covering the food products. An upper frame on the cabinet defines an open area at the front of the product server. The open area is unobstructed with respect to customers when the breath guard panel is in its lowered position and obstructed only by the breath guard panel with respect to customers at the front customer side of the product server when the breath guard panel is in its raised position whereby the breath guard panel in its raised position functions to prevent contamination that could otherwise occur through the open area.

This invention is also directed to a food product server comprising a front customer side, a rear employee side, and a cabinet having a food preparation surface adjacent the employee side of the product server for the preparation of food orders. A rectangular breath guard on the cabinet is pivoted adjacent the customer side of the product server for movement between a lowered generally horizontal position covering food products held by the product server and a raised position. The breath guard has a breath guard configuration such that when it is in its raised position it provides a barrier to contamination of the food products by customers on the customer side of the product server while allowing access to food products by employees on the employee side of the product server. Upright side panels are provided adjacent opposite ends of the product server. The breath guard extends between the upright side panels as it moves between its raised and lowered positions. A seal is provided on a bottom side of the breath guard around a periphery of the breath guard for sealing contact with a top surface of the cabinet around the periphery of the breath guard when the breath guard is in its lowered position extending over the food products. An upper frame on the cabinet defines an open area at the front of the product server. The open area is unobstructed with respect to customers when the breath guard panel is in its lowered position and obstructed only by the breath guard panel with respect to customers at the front customer side of the product server when the breath guard panel is in its raised position whereby the breath guard panel in its raised position functions to prevent contamination that could otherwise occur through the open area.

This invention is also directed to a food product server comprising a front customer side, a rear employee side, and a cabinet having a food preparation surface adjacent the rear employee side of the product server for the preparation of food orders. A transparent rectangular breath guard panel is mounted for pivotal movement with respect to the cabinet adjacent the front customer side of the product server between a lowered generally horizontal position covering food products held by the product server and a raised position. The breath guard panel has a breath guard configuration such that when it is in its raised position it provides a barrier to contamination of the food products by customers at the front customer side of the product server while allowing access to food products by employees at the employee side of the product server. Upright side panels are provided adjacent opposite ends of the product server. The breath guard panel extends between the upright side panels as it moves between its raised and lowered positions. A shelf is spaced above the cabinet and extends between the upright side panels. An open area is defined at the front of the product server below the shelf and between the upright side panels. The open area is unobstructed with respect to customers when the breath guard is in its lowered position. The open area is obstructed only by the breath guard with respect to customers at the front customer side of the product server when the breath guard is in its raised position whereby the breath guard in its raised position functions to prevent contamination that could otherwise occur through the open area.

This invention is also directed to a food product server comprising a front customer side, a rear employee side, and a cabinet having a food preparation surface adjacent the rear employee side of the product server for the preparation of food orders. A transparent breath guard panel is mounted for pivotal movement with respect to the cabinet adjacent the front customer side of the product server between a lowered generally horizontal position covering food products held by the product server and a raised position. The breath guard panel has a breath guard configuration such that when it is in its raised position it provides a barrier to contamination of the food products by customers at the front customer side of the product server while allowing access to food products by employees at the rear employee side of the product server. An upper frame on the cabinet defines an open area at the front of the product server. The open area is unobstructed with respect to customers when the breath guard panel is in its lowered position and obstructed only by the breath guard panel with respect to customers at the front customer side of the product server when the breath guard panel is in its raised position whereby the breath guard panel in its raised position functions to prevent contamination that could otherwise occur through the open area.

This invention is also directed to a product server comprising a front customer side, a rear employee side, and a cabinet having a food preparation surface adjacent the rear employee side of the product server for the preparation of food orders. A transparent breath guard panel is mounted for pivotal movement with respect to the cabinet adjacent the front customer side of the product server between a lowered generally horizontal position covering said food products held by the product server and a raised position. The breath guard panel has a breath guard configuration such that when it is in its raised position it provides a barrier to contamination of the food products by customers at the front customer side of the product server while allowing access to food products by employees at the rear employee side of the product server. The product server includes upright frame members extending up from the cabinet at spaced-apart locations along the front customer side of the product server. An open area extends between the upright frame members along the front customer side of the product server. The open area is unobstructed with respect to customers when the breath guard panel is in its lowered position and obstructed only by the breath guard panel with respect to customers at the front customer side of the product server when the breath guard panel is in its raised position whereby the breath guard panel in its raised position functions to prevent contamination that could otherwise occur through the open area.

Other objects and features of the present invention will be in part apparent and in part pointed out hereinafter.

BRIEF DESCRIPTION OF THE DRAWINGS

Corresponding parts are designated by corresponding reference numbers throughout the drawings.

DETAILED DESCRIPTION OF A PREFERRED EMBODIMENT

Figure 1:
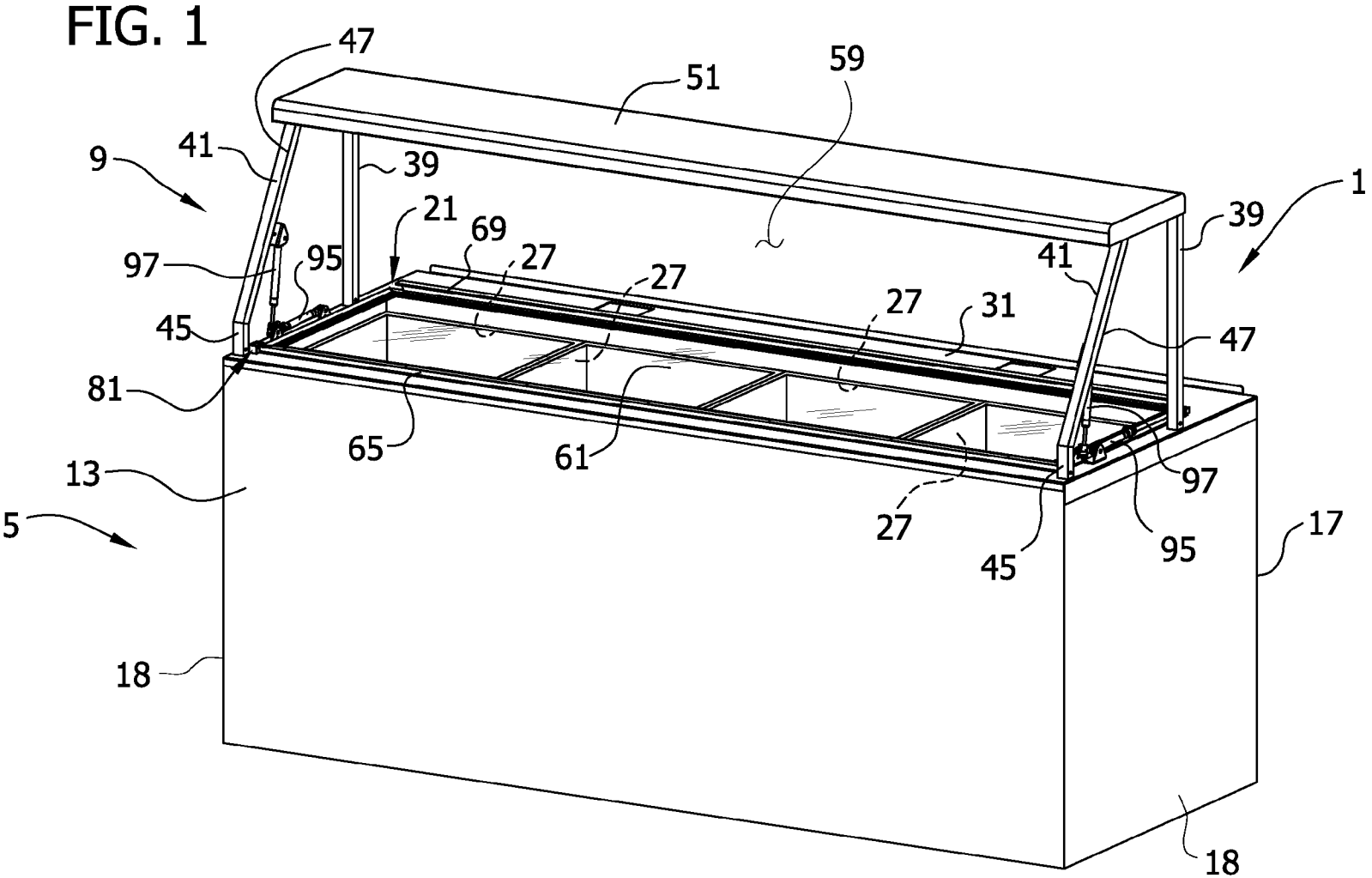
FIG. 1 is a front perspective of one embodiment of a product server of the present invention having a breath guard in a lowered position.
Figure 2:
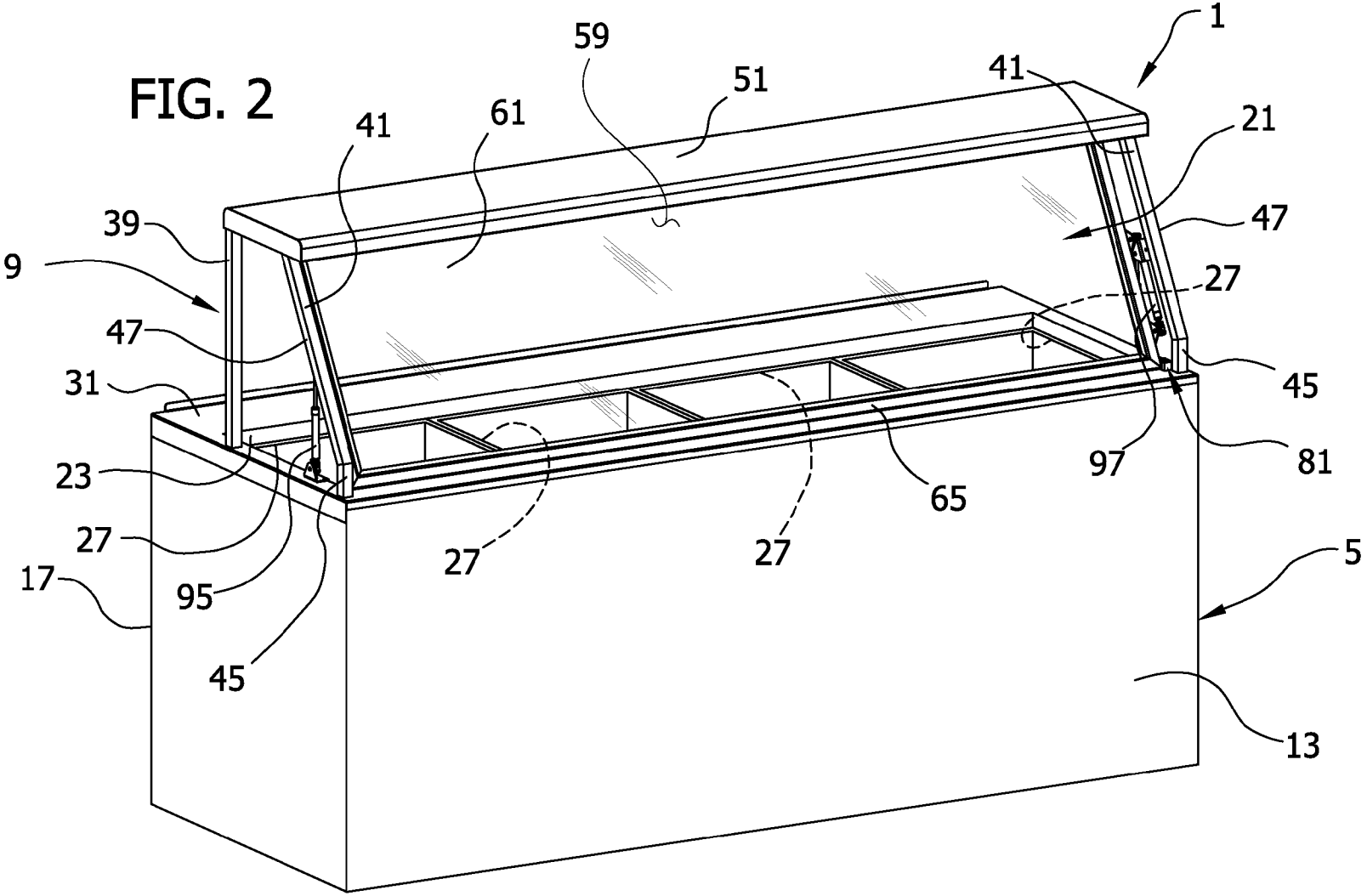
FIG. 2 is a front perspective of the product server with the breath guard in a raised position.
Figure 3A:
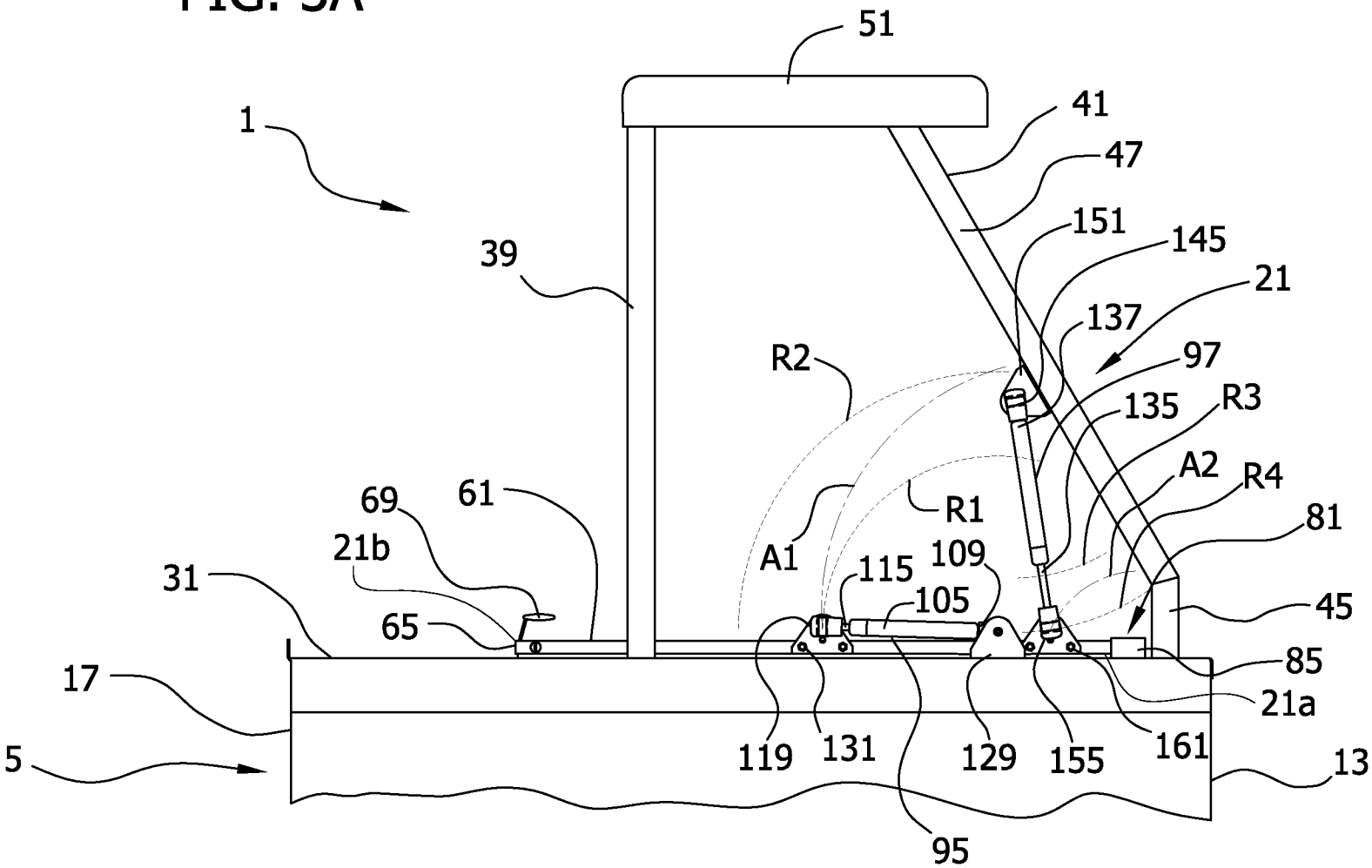
FIG. 3A is an enlarged left-side elevation of the product server with the breath guard in its lowered position.
Figure 3B:
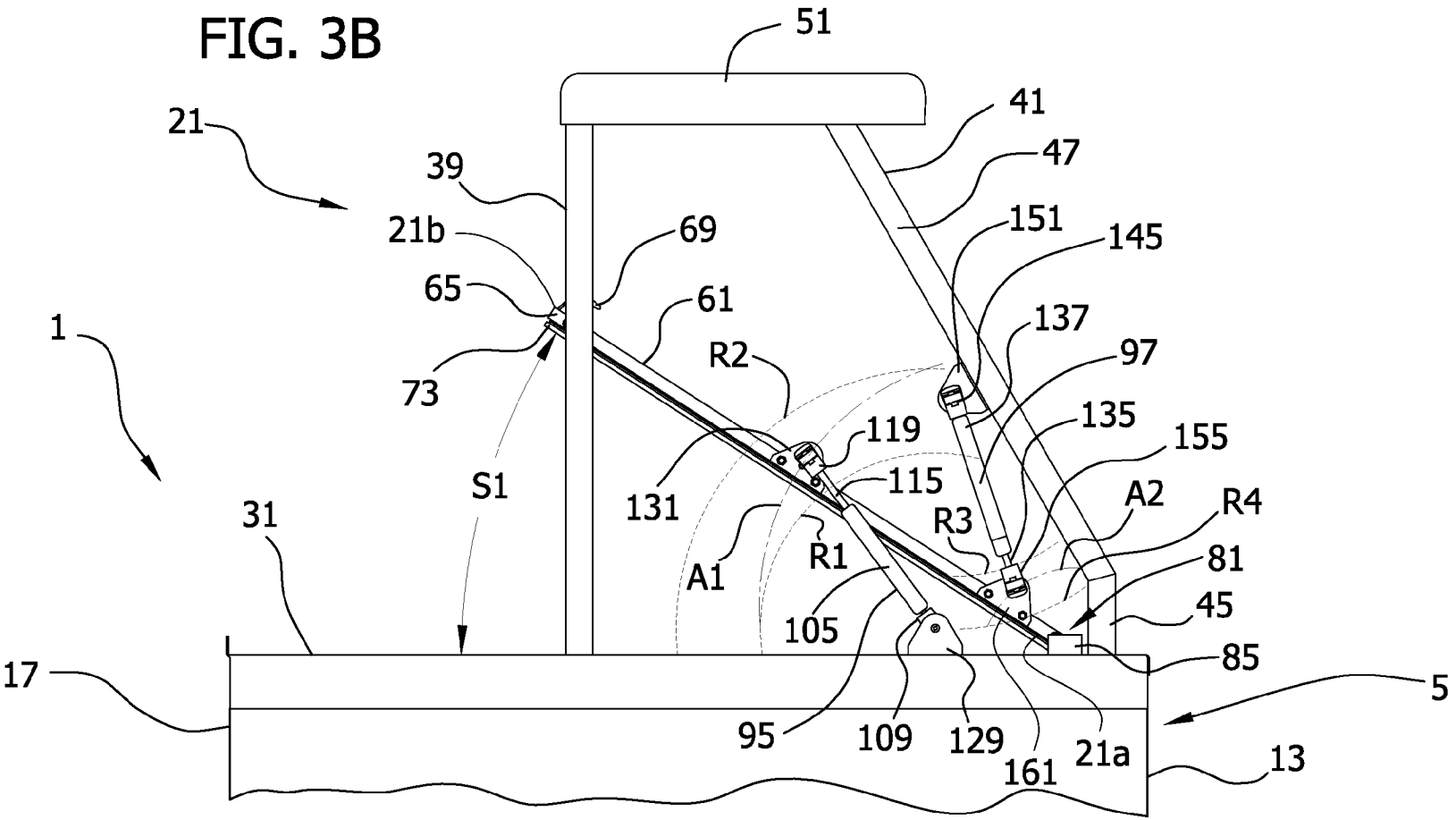
FIG. 3B is a left-side elevation similar to FIG. 3A but with the breath guard in an intermediate position.
Figure 3C:
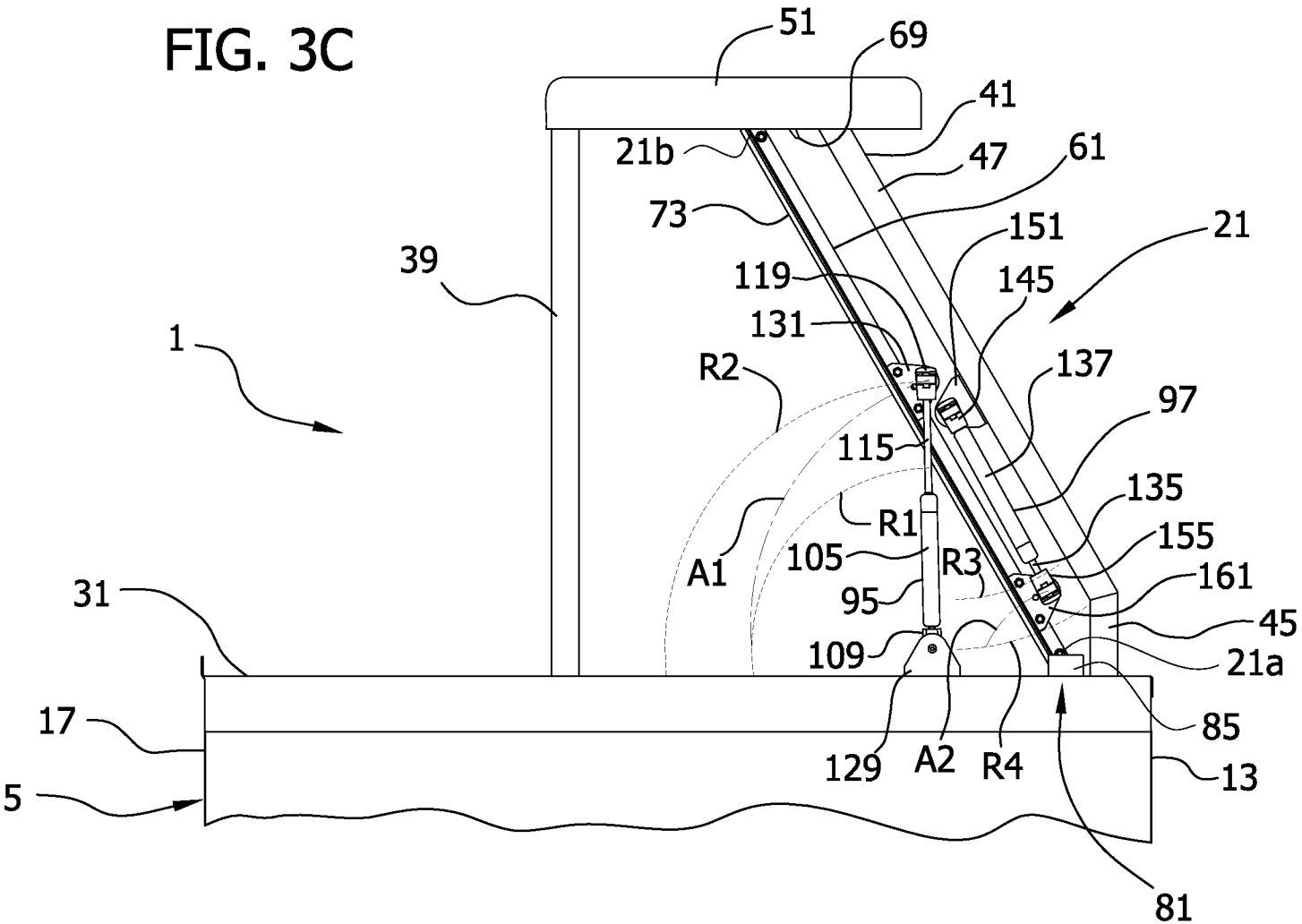
FIG. 3C is a left-side elevation similar to FIG. 3A but with the breath guard in its raised position.
Figure 4:
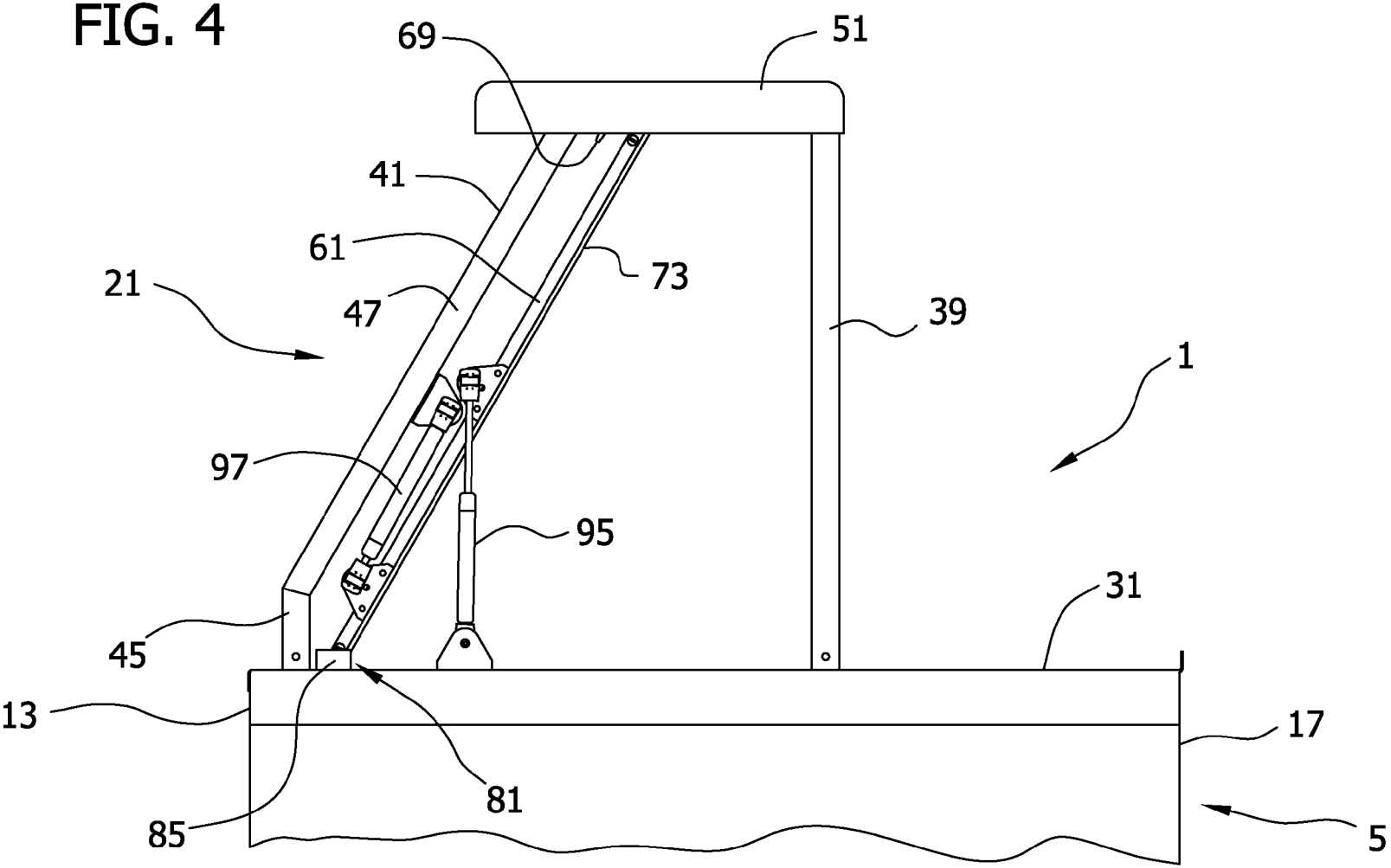
FIG. 4 is an enlarged right-side elevation view of the product server with the breath guard in its raised position.
Figure 5:
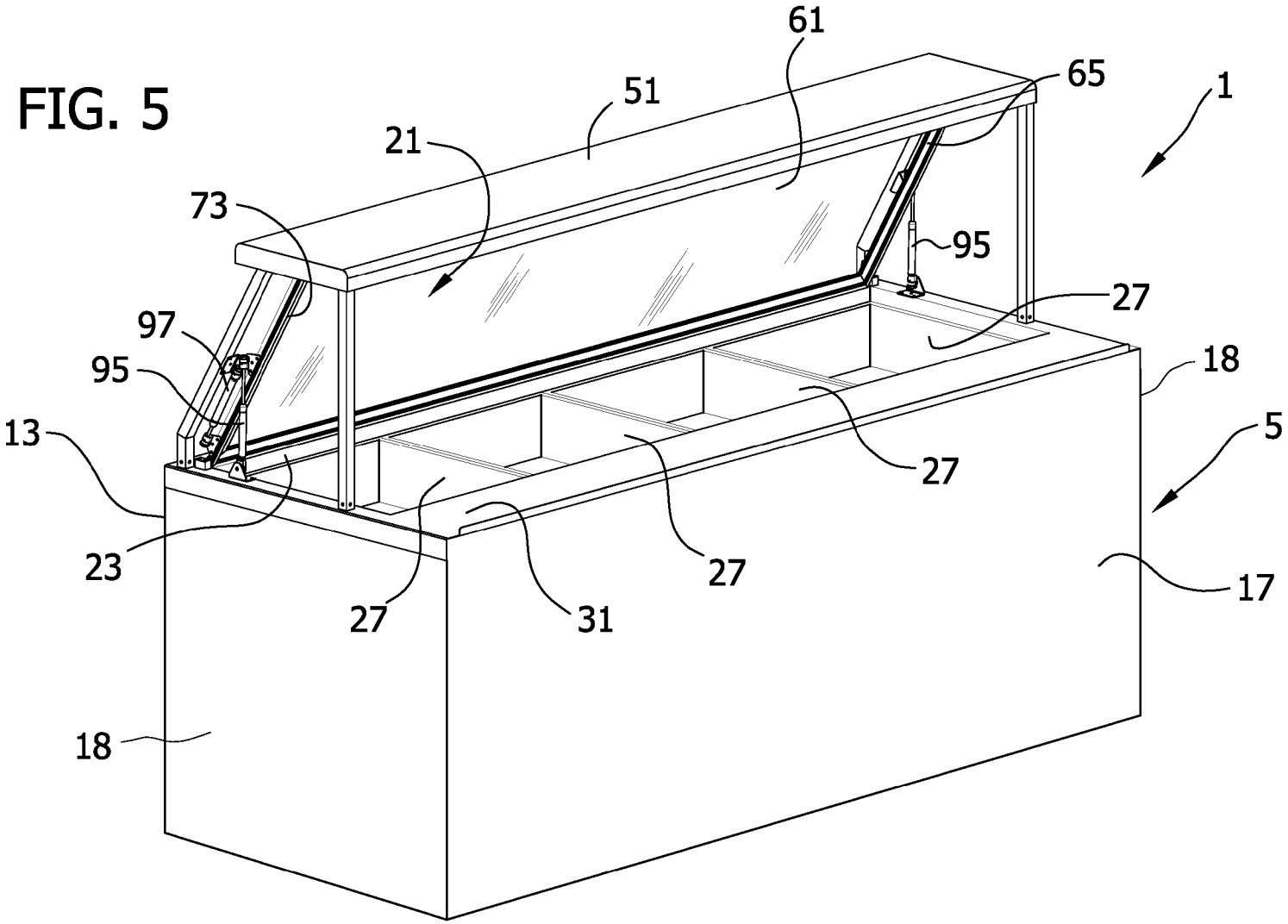
FIG. 5 is a back perspective of the product server with the breath guard in its raised position.

Referring now to the drawings, and more particularly to FIGS. 1-2, a product server of the present invention is designated in its entirety by the reference numeral 1. As shown in FIGS. 1-2, the product server 1 has a lower cabinet, generally designated 5, and an upper frame, generally designated 9, mounted on the cabinet. The server 1 has a front customer side 13, a rear employee side 17, opposite ends 18, and a breath guard, generally designated 21, moveably mounted on the server. The cabinet 5 has a recess 23 (FIG. 2) toward the front 13 of the cabinet that, in one embodiment, is adapted to support a plurality of food serving pans 27 within the cabinet. Referring to FIGS. 3A-3C, the breath guard 21 has a front side 21*a* and a rear side 21*b* corresponding to respective front and rear sides 13, 17 of the server 1, and the breath guard is generally moveable between a lowered position (FIG. 3A) in which the recess 23 is covered and a raised position (FIG. 3C) allowing access to the food pans 27 held in the recess of the cabinet 5. The cabinet has a counter top surface 31 toward the rear 17 of the server 1 that can be used to prepare a finished food product (e.g., sandwich) using the ingredients stored in the food pans 27. It will be understood that the server 1 may have a refrigeration system and/or a heating system housed in the cabinet 5 that regulates the temperature of the food pans 27. The product server 1 of the present invention is particularly useful in storing hot or cold food products that can be used by food service employees to prepare a food order on the counter top 31 of the cabinet 5.

In the illustrated embodiment, the support frame 9 comprises a pair of upright frame members 39, 41 extending up from the cabinet 5 adjacent each side of the product server 1. One frame member 39 of each pair is located near the rear 17 of the product server 1 and the other frame member 41 of each pair is located near the front 13 of the server. In one embodiment, each of the two rear frame members 39 is generally an upright frame member that extends vertically from the top surface 31 of the cabinet 5. Each of the front frame members 41 has a short vertical lower section 45 that extends upward from the top surface 31 of the cabinet 5 and an angled upper section 47 that slopes up toward the rear 17 of the cabinet. The frame 9 has a top shelf 51 spaced above the cabinet 5 that is supported by the frame members 39, 41 and affixed thereto. It will be understood that the top shelf 51 may be made of suitable metal (e.g., stainless steel or galvanized steel) and affixed to the frame members 39, 41 via any conventional fasteners such as threaded fasteners, rivets, or welded connections. The top shelf 51 is particularly useful in supporting a menu board (not shown) or other item(s) displaying information regarding the products held within the server 1. It will be understood that the product server 1 could include one or more side panels (not shown) affixed to the frame members 39, 41 at each side of the server. These side panels may be made from the same material as the top shelf 51 or may have one or more transparent windows for viewing products within the server 1. As shown in FIG. 1, the frame 9 defines the open area 59 at the front of the product server below the shelf 51 and between the frame members 39, 41 (and the upright side panels, if included).

As seen in FIGS. 1 and 2, the breath guard 21 comprises a panel 61 that, in the illustrated embodiment, is a rectangular panel moveably mounted on the product server 1. The panel 61 is preferably sufficiently transparent to allow viewing of at least some of the products held within the server 1. For example, the panel 61 may be of acrylic or glass. The panel 61 is generally moveable between a lowered position, shown in FIG. 1, in which the panel lies in a generally horizontal plane and prevents access to the food pans 27 held in the cabinet 5 and a raised position, shown in FIG. 2, allowing access to the food pans from the employee side 17 of the server 1. As shown in FIG. 1, the open area 59 is unobstructed with respect to customers at the front of the food product server 1 when the breath guard panel 61 is in its lowered position. On the other hand, as shown in FIG. 2, the open area 59 is obstructed only by the transparent panel 61 with respect to such customers when the panel is in its raised position. As a result, the transparent panel in its raised position functions to prevent contamination from the customers that could otherwise occur through the open area 59. In the illustrated embodiment, the panel 61 is supported by a metal (e.g., stainless steel) frame 65 around the periphery of the panel. As best seen in FIGS. 3A and 3B, a handle 69 on the top side of the panel 61 extends up from the frame 65 for grasping by an operator. The panel 61 has a seal 73 made of resilient material (e.g., rubber) around the periphery of the bottom side of the panel 61 for sealing contact with the top surface 31 of the cabinet 5 when the panel is in the lowered position. The seal 73 allows the food products held within the food pans 27 to remain fresh when the panel 61 is lowered.

Figure 6:
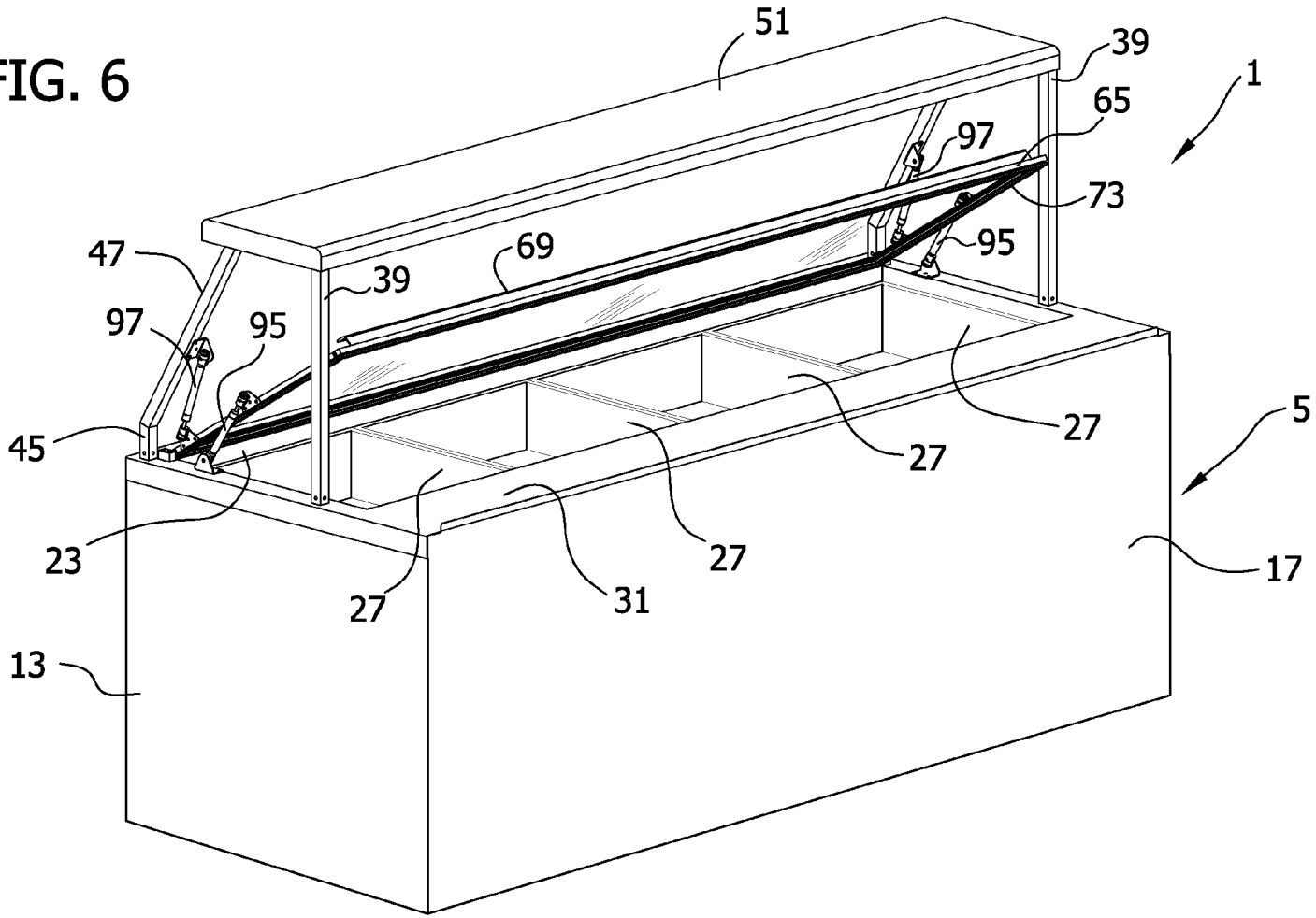
FIG. 6 is an back perspective of the product server with the breath guard in its intermediate position.
Figure 6A:
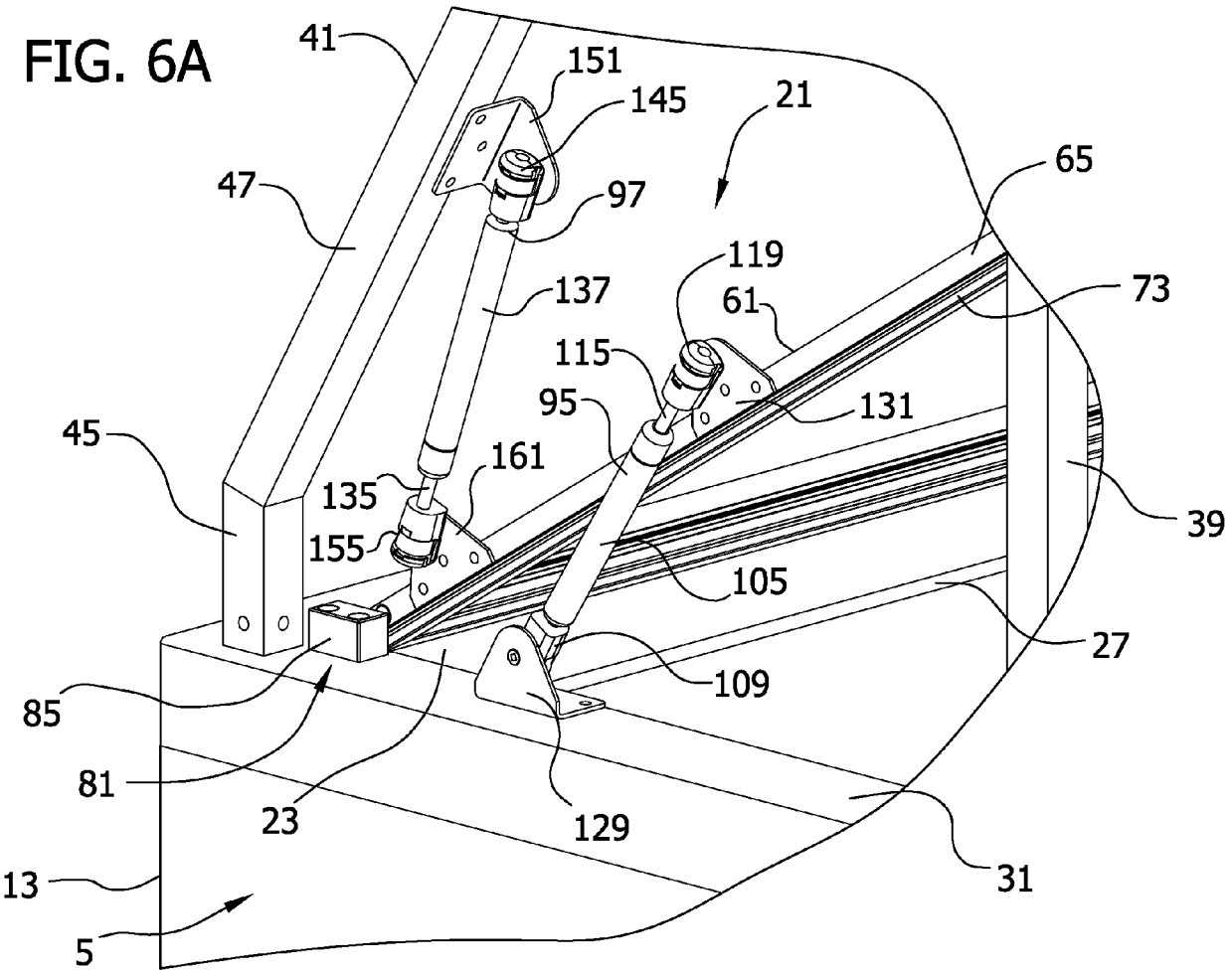
FIG. 6A is an enlarged portion of FIG. 6 showing two power assist devices attached to the breath guard.
Figure 6B:
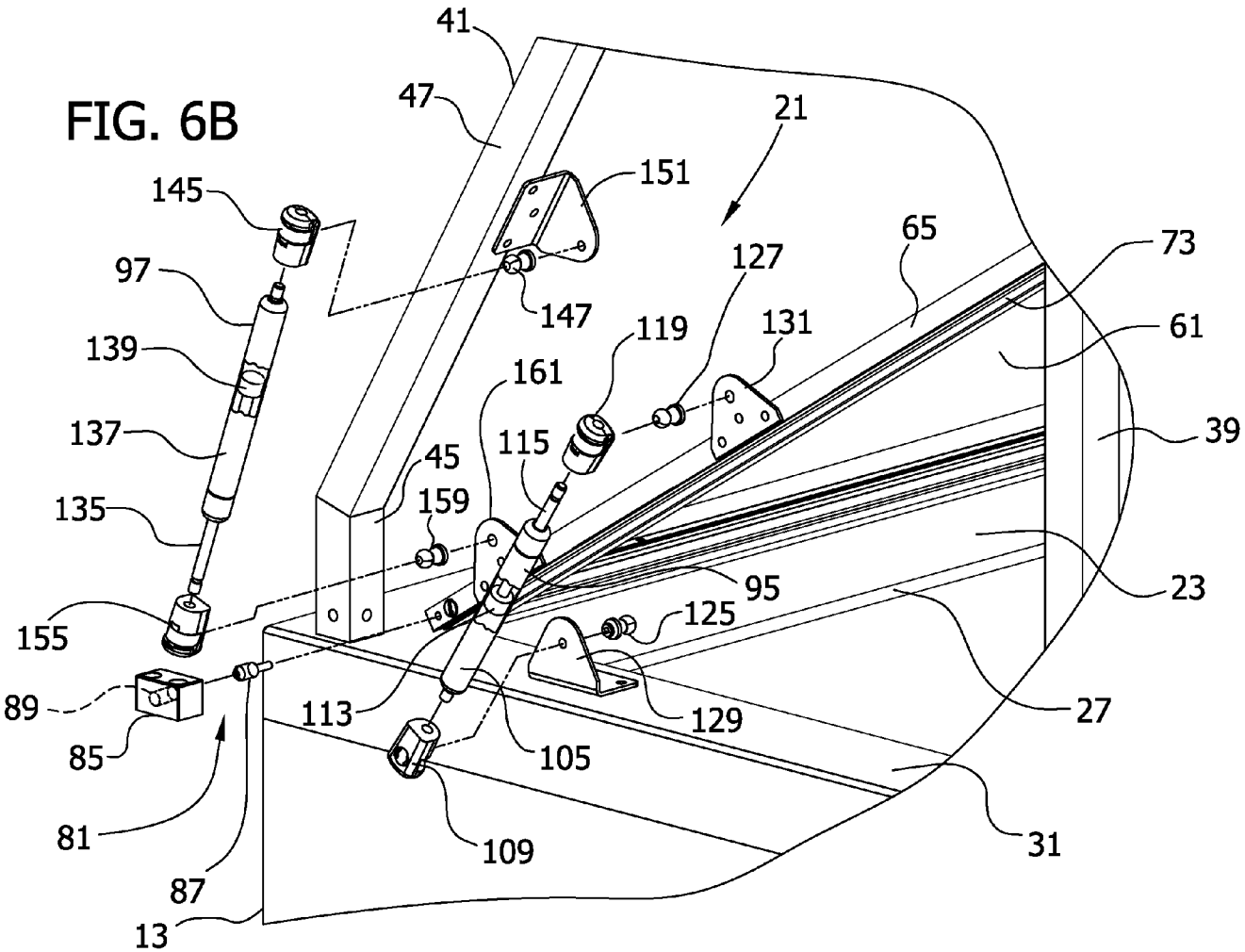
FIG. 6B is an exploded perspective of FIG. 6A showing the power assist devices removed from the breath guard with a cylinder of each power assist device partially broken away to show internal details.

In one embodiment, the panel 61 is pivotably attached to the cabinet 5 by two hinge connections, generally designated 81, on the top of the cabinet adjacent opposite sides of the cabinet generally near the front 13 of the server 1. As seen in FIGS. 6A and 6B, each hinge connection 81 comprises a hinge block 85 secured to the top 31 of the cabinet 5 and a hinge pin 87 affixed to the frame 65 of the panel 61 and rotatable in a hole 89 in the block. Preferably, the hinge pins 87 are constructed from durable material with a low coefficient of friction (e.g., hard rubber) to allow the panel 61 to freely pivot with respect to the hinge block 85 affixed to the cabinet. In the illustrated embodiment, each hinge block 85 is constructed from a solid piece of steel (e.g., cold rolled or stainless steel) with a machined hole 89 for receiving a respective hinge pin 87, but it will be understood that the hinge pins and hinge blocks could be constructed of other materials and have different configurations without departing from the scope of this invention. The pivoting action of the panel 61 allows the breath guard 21 to be positioned at any angular position between its lowered position in which the panel seals the food pans 27 held in the recess 23 of the cabinet 5 and its raised position in which the panel is position substantially parallel to the angled section 47 of the front frame members 41.

The product server 1 of the present invention also comprises two pairs of power assist devices 95, 97 located on top of the cabinet 5 and operatively attached to the breath guard 21 adjacent opposite ends 18 of the product server. In one embodiment, each pair of power assist devices at a respective side of the breath guard 21 comprises a gas spring 95 toward the rear 17 of the server 1 and a damper 97 toward the front 13 of the server. Each gas spring 95 is pivotably attached at one end to the top surface 31 of the counter 5 and at its other end to the metal frame 65 of the breath guard panel 61. In the illustrated embodiment, each gas spring 95 comprises a nitrogen gas spring of conventional construction such as the type that is commercially available from H.A. Guden Company of Ronkonkoma, N.Y. It will be understood that other types of power assist devices (e.g., pneumatic or hydraulic operated cylinders) are within the scope of this invention.

As seen in FIGS. 6A and 6B, each gas spring 95 generally comprises a cylinder 105 having a closed end fitting 109 for connection to the product server 1 and a piston assembly including a piston 113 that is moveable within the cylinder and a piston rod 115 extending from the rod end of the cylinder. A rod end fitting 119 similar to the closed end fitting 109 is attached to the end of the piston rod 115 for attachment of the gas spring 95 to the glass panel 61. The rod end fitting 119 on the piston rod 115 is moveable with the rod as the piston 113 moves inside the cylinder 105 of the gas spring 95. In one embodiment, the cylinder 105 of each gas spring 95 contains pressurized nitrogen gas that exerts a force against the piston 113 that moves it toward the rod end of the cylinder, thus extending the piston rod 115 from the cylinder. It will be understood that the amount of output force exerted by the gas spring 95 is directly proportional to the force exerted by the gas in the cylinder 105 on the piston 113 and the size of the piston rod 115 affixed to the piston. As a result, the force exerted by the gas spring 95 will vary between a maximum value when the piston 113 is fully retracted into the cylinder 105 at the beginning of its stroke and a minimum value when the piston rod 115 is fully extended at the end of its stroke. Reference may be made to U.S. Pat. No. 4,194,731 and U.S. Pat. No. 5,797,593, incorporated by reference herein for all purposes, for additional background information relating to gas springs and their internal components.

As best seen in FIGS. 6A and 6B, each rod end fitting 119 and closed end fitting 109 of the gas spring 95 comprises a socket connector attached to the corresponding rod 115 of the gas spring or the closed end of the cylinder 105. Each socket connector 109, 119 of the gas spring 95 receives a respective ball connector 125, 127 affixed to a corresponding bracket 129, 131 on the product server 1 and on the panel 61 to form a snap-on ball and socket attachment that allows the cylinder 105 to pivot as the panel is raised and lowered. The ball and socket connection formed by the socket connector 109 and the ball connector 125 at the closed end of the cylinder 105 allows the gas spring 95 to pivot about a fixed point on the product server 1 as the panel 61 is moved. The ball and socket connection formed by the socket connector 119 and the ball connector 127 at the rod end of the gas spring 95 allows the panel 61 to pivot with respect to the gas spring. The gas springs 95 may be connected to the cabinet 5 and panel 61 in other ways.

Each gas spring 95 applies an axial force tending to extend the piston rod 115 away from the closed end of the cylinder 105. In the illustrated embodiment, the gas spring 95 is positioned so that when the panel 61 is raised by a manual lifting force, each cylinder 105 pivots so that the vertical component of the extension force of the gas spring increases to assist in raising the panel. It will be understood that the size, location and amount of extension force required of the gas spring 95 will depend on the size and weight of the glass panel 61, the friction forces in the hinge connection 81 of the panel, and the amount of lifting force that is desired to assist in raising the panel.

In the illustrated embodiment, the second power assist device 97 comprises a damper that provides a dampening force to restrain movement of the panel 61 from its raised to its lowered position. The purpose of the damper 97 is to slow the downward movement of the glass panel 61 so the panel is not damaged by rapid uncontrolled movement from its raised to its lowered position. In the illustrated embodiment, the damper 97 is of the type commercially available from H.A. Guden Company of Ronkonkoma, N.Y. The damper 97 is similar in appearance and construction as the gas spring 95 but does not have a nitrogen gas charge causing a force to be exerted on the panel 61. Rather the damper 97 is a force-absorbing device that is configured so that the piston rod 135 can only be extended from the cylinder 137 at a controlled speed. For example, the damper 97 may comprise a cylinder 137 filled with hydraulic fluid, and a piston 139 with a small orifice (not shown) for passing the fluid as the piston reciprocates in the cylinder, thus controlling the speed of stroke of the piston in the cylinder.

Each damper 97 has similar mounting components as the gas springs 95 and is affixed to the panel 61 and the cabinet 5 of the food server 1 with a snap-on ball and socket connection at each end of the damper. As seen in FIGS. 6A and 6B, each damper 97 has a closed end fitting 145 comprising a socket connector attached to the cylinder 137 and pivotably attached to a ball connector 147 affixed to a bracket 151 mounted to the angled upper section 47 of the front frame member 41. Each damper 97 also has a rod end fitting 155 comprising a socket connector attached to the piston rod 135 extending from the cylinder 137 and pivotably attached to a ball connector 159 affixed to a bracket 161 secured to the frame 65 of the panel 61. In the illustrated embodiment, the damper 97 is attached to the panel 61 at a point forward of the bracket 131 connecting the gas spring 95 to the panel 61, but it will be understood that the damper could be otherwise located. As seen in FIGS. 6A and 6B, the ball and socket connection formed by the socket connector 145 and ball connector 147 connecting the damper 97 to the frame 9 allows the damper to pivot around a fixed point on the angled upper section 47 of the frame when the panel 61 is moved. The ball and socket connection formed by the socket connector 155 and the ball connector 159 connecting the damper 97 to the panel 61 allows the panel to pivot with respect to the damper. The damper 97 may be connected to the frame 9 and panel 61 in other ways.

In one exemplary embodiment, the gas spring 95 and the damper 97 each have a stroke of about 3 inches, an extended length of about 10 inches, a retracted length of about 7 inches, a piston rod diameter of about ¼ inch, and a cylinder inner diameter of about 0.6 inch. In one embodiment, the output force of the gas spring 95 at full retraction is approximately 20 lbs. It will be understood that the gas spring 95 and damper 97 described above can have other dimensions and can be otherwise arranged without departing from the scope of this invention.

In operation, the breath guard 21 mounted on the server 1 of the present invention is pivotable between the lowered position shown in FIGS. 1 and 3A and the raised position shown in FIGS. 2, 3C, 4 and 5. The lowered position of the breath guard 21 allows the panel 61 to effectively seal the food pans 27 held in the temperature controlled cabinet 5 of the server 1. The raised position of the breath guard 21 allows access to the products held within the server 1 from the employee side 17 and also protects the products from airborne contaminates originating from the customer side 13 of the server.

As shown in FIG. 3A, each gas spring 95 is positioned to be substantially parallel with the glass panel 61 when the panel is in its lowered position so that the vertical component of the spring force is minimal. In the lowered position, the vertical component of the spring force of the gas spring 95 does not overcome the weight of the panel 61. To raise the panel 61 from the lowered position an upward force is applied to the handle 69 of the panel to pivot the panel toward its raised position. As the panel 61 swings up, the piston rod 115 of the gas spring 95 extends from the cylinder 105 of the gas spring and the gas spring pivots, increasing the vertical component of the spring force. When the panel 61 is in an intermediate position (e.g., see FIG. 3B), the vertical component of the spring force balances the downward force of the panel due to the weight of the panel. In this intermediate position, the panel 61 is positioned at the self-rise angle S1 of the breath guard 21 which is the position in which no additional lifting force is required to raise the panel to its raised position as shown in FIG. 3C. The self-rise angle S1 is typically between about 10 degrees and about 40 degrees with respect to the top counter 31 of the product server 1. In the embodiment of FIG. 3C, the self-rise angle S1 is about 30 degrees and it will be understood that the magnitude of this angle will vary dependent on the size of the glass panel 61, the size, location, and output force of the gas springs 95, and the friction losses in the hinge connections 81 and the gas spring connections. At the position shown in FIG. 3C, the panel 61 is raised to its most near-vertical position allowed by the configuration of the breath guard 21. In this raised position, the panel 61 is positioned to allow full access to the products held within the product server 1 and to provide a barrier to contamination from the customer side 13 of the server. In the illustrated embodiment, the angle of incline at the raised position is approximately 70 degrees but it will be understood that this angle may vary between approximately 45 degrees and approximately 90 degrees.

The dampers 97 are configured to resist downward movement of the panel 61 so that the panel is lowered from the raised position of FIG. 3C to the lowered position of FIG. 3A by controlled movement that prevents damage to the panel. In the intermediate position shown in FIG. 3B, the panel 61 is also positioned at the self-close angle S1 of the breath guard, which is the angle at which the panel will close without the application of downward force by the operator. At the self-close angle, the downward force from the weight of the panel 61 is sufficient to overcome the vertical component of the gas spring force so that no supplemental closing force is needed. It will be understood that the breath guard 21 may be configured so that the self-close angle is more or less than 30 degrees as shown in FIG. 3B. The self-close angle may vary depending on the positioning of the gas springs 95 and the friction forces of the hinge connections 81 on the server.

As shown in FIGS. 3A thru 3C, the rod end fitting 119 of each gas spring 95 travels along the arc designated A1 when the panel is moved between its lowered and raised positions. The arc A1 of the gas spring extends between the minimum extension radius R1 of the spring and the maximum extension radius R2 of the spring. Similarly, the rod end fitting 155 of each damper 97 travels along the arc designated A2 when the panel is moved between its lowered and raised positions. The arc A2 of the damper extends between the minimum extension radius of the damper R3 and the maximum extension radius R4 of the damper. The distance between respective minimum extension radii R1, R3 and respective maximum extension radii R2, R4 of the spring 95 and the damper 97 is equal to the stroke length of each respective power assist device. In the illustrated embodiment, the stroke length of both the gas spring 95 and the damper 97 is approximately 3 inches, but the spring and the damper could be otherwise configured so that the stroke length may vary without departing from the scope of this invention.

Figure 7:
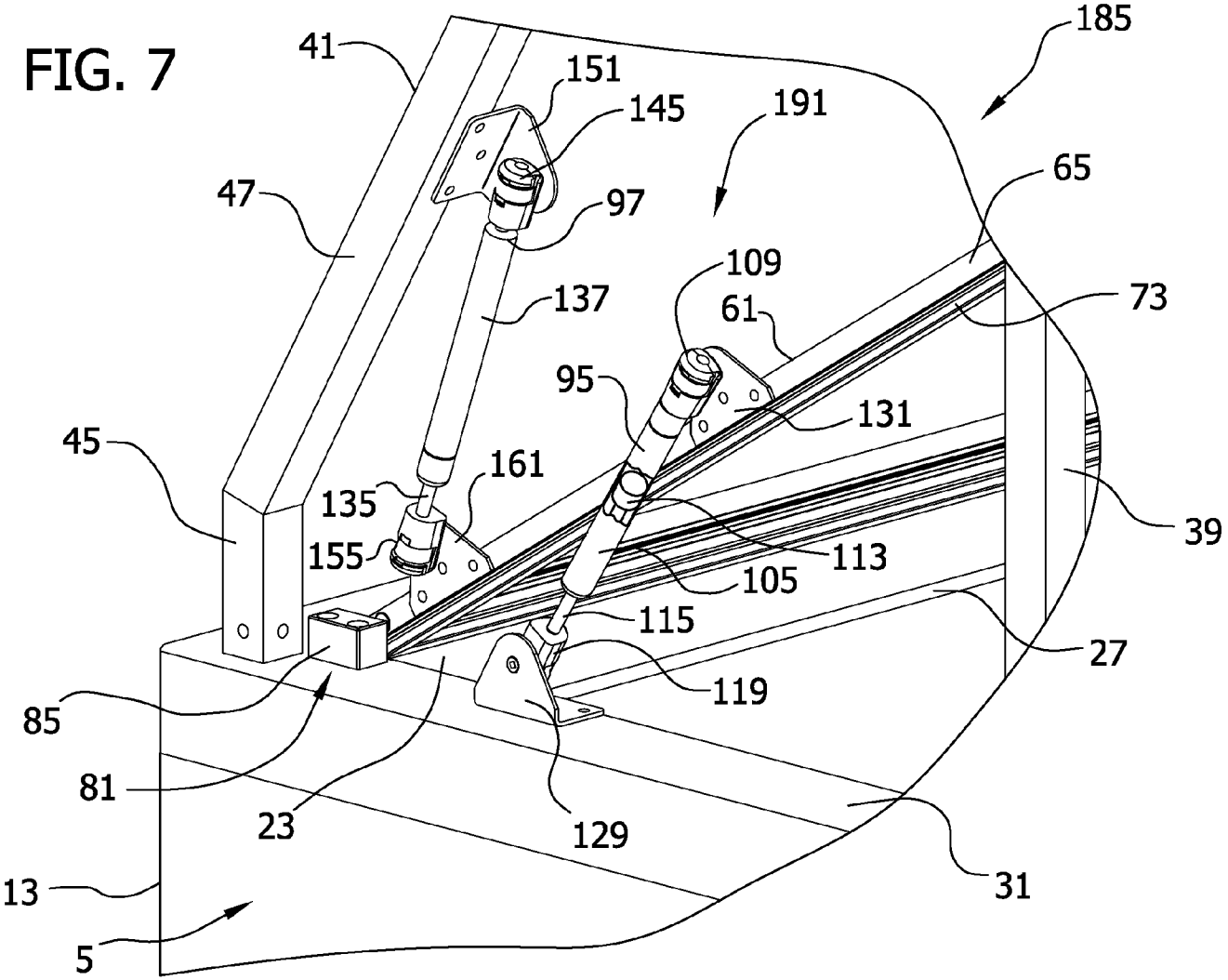
FIG. 7 is view similar to FIG. 6A but showing an alternative embodiment of the server with a cylinder of one of the power assist devices partially broken away to show internal details.

FIG. 7 illustrates an alternative embodiment of the product server, generally designated 185, having a breath guard 191 which is substantially similar to the breath guard 21 of the previous embodiment except the gas spring 95 is mounted on the breath guard in an inverted position. In the embodiment of FIG. 7, the gas spring 95 is positioned so that rod end fitting 119 is attached to the bracket 129 mounted on the counter top 31 of the product server 1. The closed end fitting 109 of the gas spring 95 is attached to the bracket 131 mounted to the glass panel 61. In the operation of the breath guard 191, the cylinder 105 of the gas spring 95 moves with the panel 61 so that as the panel is raised and lowered, the cylinder axially telescopes with respect to the piston 113 and piston rod 115 attached to the server 185 by the pivot connection between the rod end fitting 119 and the bracket 129. The force exerted by the gas spring 95 tends to move the cylinder 105 away from the rod end fitting 119 to assist in moving the panel 61 to the raised position of the breath guard 191.

In view of the above, it will be seen that the several objects of the invention are achieved and other advantageous results attained. For example, the product server 1 with the generally transparent moveable panel 61 of the breath guard 21 allows products held in the server to be displayed to customers from the customer side 13 of the server. The panel 61 is pivotable to allow access to the products from the employee side 17 of the server 1. The panel 61 has a seal 73 that contacts the top of the server 1 when the panel 61 is in its lowered position to protect products in the server from contamination. When the panel 61 is raised, the breath guard 21 presents a barrier that prevents contamination of the products from the customer side 13 of the server. The product server has power assist devices in the form of gas springs 95, for example, that assist in the pivotal movement of the panel 61 to its raised position and dampers 97 that provide for controlled downward movement of the panel to its lower position.

As various changes could be made in the above constructions without departing from the scope of the invention, it is intended that all matter contained in the above description or shown in the accompanying drawings shall be interpreted as illustrative and not in a limiting sense. For example, the shape and construction of the support frame 9 of the breath guard 21 may vary. Further, the type, size, number, and location of the power assist devices 95, 97 may vary. The product server 1 could comprise a breath guard 21 that has only dampers 97 and no gas springs 95 or a breath guard that has only gas springs 95 and no dampers 97. The number of dampers 97 and/or gas springs 95 can vary. The relative sizes of the moveable panel 61 of the breath guard 21 and the product storage section of the server 1 may also vary. Selected walls of the product server 1 may be used to display advertising, if desired.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A product server for holding and displaying food products, the product server comprising a front customer side, a rear employee side, a cabinet having a food preparation surface adjacent the employee side of the product server for the preparation of food orders, a rectangular breath guard on the cabinet, said breath guard being pivoted adjacent the customer side of the product server for movement between a lowered generally horizontal position covering said food products held by the product server and a raised position, said breath guard having a breath guard configuration such that when it is in its raised position it provides a barrier to contamination of the food products by customers on the customer side of the product server while allowing access to said food products by employees on the employee side of the product server, upright side panels adjacent opposite ends of the product server, wherein the breath guard extends between the upright side panels as it moves between its raised and lowered positions, wherein the breath guard comprises a breath guard panel that lies in a generally horizontal plane when the breath guard is in its lowered position covering said food products, and an upper frame on the cabinet defining an open area at the front of the product server, said open area being unobstructed with respect to said customers when the breath guard panel is in its lowered position and obstructed only by the breath guard panel with respect to said customers at the front customer side of the product server when the breath guard panel is in its raised position whereby the breath guard panel in its raised position functions to prevent said contamination that could otherwise occur through the open area.

2. The product server of claim 1, wherein said upper frame comprises a top shelf extending between the side panels above the cabinet and the breath guard.

3. The product server of claim 2, wherein the rectangular breath guard has front and rear sides toward respective front and rear sides of the product server, and wherein the rear side of the breath guard is positioned adjacent and below the shelf when the breath guard is in its raised position.

4. The product server of claim 3, wherein the breath guard panel is transparent.

5. The product server of claim 4, further comprising a first device operable to apply a lifting force to assist in raising the breath guard and a second device operable to apply a damping force to the breath guard as it is lowered.

6. The product server of claim 5, wherein said upper frame comprises upright frame members supporting respective upright side panels, said upright frame members having angled sections that slope up toward the rear employee side of the product server.

7. The product server of claim 6, wherein said breath guard panel angles upward toward the rear employee side of the product server alongside and generally parallel to said angled sections of the upright frame members when the breath guard is in its raised position.

8. The product server of claim 1, further comprising a first device operable to apply a lifting force to assist in raising the breath guard and a second device operable to apply a damping force to the breath guard as it is lowered.

9. The product server of claim 1, wherein the upper frame extends between the side panels above the cabinet and the breath guard.

10. The product server of claim 9, wherein the rectangular breath guard has front and rear sides toward respective front and rear sides of the product server, and wherein the rear side of the breath guard is positioned adjacent and below the frame when the breath guard is in its raised position.

11. The product server of claim 10, wherein the breath guard panel is transparent and a breath guard frame surrounds the panel.

12. The product server of claim 11, further comprising a first device operable to apply a lifting force to assist in raising the breath guard and a second device operable to apply a damping force to the breath guard as it is lowered.

13. The product server of claim 12, wherein said upper frame comprises upright frame members supporting respective upright side panels, and wherein said upright frame members have angled sections that slope up toward the rear employee side of the product server.

14. The product server of claim 13 wherein said breath guard panel angles upward toward the rear employee side of the product server alongside and generally parallel to the angled sections of said upright frame members when the breath guard is in its raised position.

15. The product server of claim 1, wherein the breath guard comprises a seal on a bottom side of the breath guard around a periphery of the breath guard for sealing contact with a top surface of the cabinet around the periphery of the breath guard when the breath guard is in said lowered position extending horizontally over the food products.

16. The product server of claim 1, wherein the breath guard comprises a frame around a periphery of the breath guard panel.

17. A product server for holding and displaying food products, the product server comprising a front customer side, a rear employee side, a cabinet having a food preparation surface adjacent the employee side of the product server for the preparation of food orders, a rectangular breath guard on the cabinet, said breath guard being pivoted adjacent the customer side of the product server for movement between a lowered generally horizontal position covering said food products held by the product server and a raised position, said breath guard having a breath guard configuration such that when it is in its raised position it provides a barrier to contamination of the food products by customers on the customer side of the product server while allowing access to said food products by employees on the employee side of the product server, upright side panels adjacent opposite ends of the product server, wherein the breath guard extends between the upright side panels as it moves between its raised and lowered positions, a seal on a bottom side of the breath guard around a periphery of the breath guard for sealing contact with a top surface of the cabinet around the periphery of the breath guard when the breath guard is in said lowered position extending over the food products, and an upper frame on the cabinet defining an open area at the front of the product server, said open area being unobstructed with respect to said customers when the breath guard panel is in its lowered position and obstructed only by the breath guard panel with respect to said customers at the front customer side of the product server when the breath guard panel is in its raised position whereby the breath guard panel in its raised position functions to prevent said contamination that could otherwise occur through the open area.

18. A product server for holding and displaying food products, the product server comprising a front customer side, a rear employee side, a cabinet having a food preparation surface adjacent the rear employee side of the product server for the preparation of food orders, a transparent rectangular breath guard panel mounted for pivotal movement with respect to the cabinet adjacent the front customer side of the product server between a lowered generally horizontal position covering said food products held by the product server and a raised position, said breath guard panel having a breath guard configuration such that when it is in its raised position it provides a barrier to contamination of the food products by customers at the front customer side of the product server while allowing access to said food products by employees at the employee side of the product server, upright side panels adjacent opposite ends of the product server, the breath guard panel extending between the upright side panels as it moves between its raised and lowered positions, a shelf spaced above the cabinet and extending between the upright side panels, and an open area at the front of the product server below the shelf and between the upright side panels, wherein the open area is unobstructed with respect to said customers when the breath guard is in its lowered position, and wherein the open area is obstructed only by the breath guard with respect to said customers at the front customer side of the product server when the breath guard is in its raised position whereby the breath guard in its raised position functions to prevent said contamination that could otherwise occur through the open area.

19. The product server of claim 18, wherein the breath guard panel in its lowered position lies in a generally horizontal plane covering said food products.

20. A product server for holding and displaying food products, the product server comprising a front customer side, a rear employee side, a cabinet having a food preparation surface adjacent the rear employee side of the product server for the preparation of food orders, a transparent breath guard panel mounted for pivotal movement with respect to the cabinet adjacent the front customer side of the product server between a lowered generally horizontal position covering said food products held by the product server and a raised position, said breath guard panel having a breath guard configuration such that when it is in its raised position it provides a barrier to contamination of the food products by customers at the front customer side of the product server while allowing access to said food products by employees at the rear employee side of the product server, an upper frame on the cabinet defining an open area at the front of the product server, said open area being unobstructed with respect to said customers when the breath guard panel is in its lowered position and obstructed only by the breath guard panel with respect to said customers at the front customer side of the product server when the breath guard panel is in its raised position whereby the breath guard panel in its raised position functions to prevent said contamination that could otherwise occur through the open area.

21. The product server of claim 20, wherein the upper frame comprises a shelf above the cabinet, and wherein the open area is below the shelf.

22. The product server of claim 20, wherein the breath guard panel has front and rear sides toward respective front and rear sides of the product server, and wherein the rear side of the breath guard panel is positioned below the shelf when the breath guard is in its raised position.

23. The product server of claim 20, wherein the breath guard panel is rectangular.

24. The product server of claim 20, wherein the breath guard panel in its lowered position lies in a generally horizontal plane covering said food products.

25. The product server of claim 20, further comprising a first lifting device operable to assist in raising the breath guard panel and a second damper device operable to restrain movement of the breath guard panel as it is lowered.

26. A product server for holding and displaying food products, the product server comprising a front customer side, a rear employee side, a cabinet having a food preparation surface adjacent the rear employee side of the product server for the preparation of food orders, a transparent breath guard panel mounted for pivotal movement with respect to the cabinet adjacent the front customer side of the product server between a lowered generally horizontal position covering said food products held by the product server and a raised position, said breath guard panel having a breath guard configuration such that when it is in its raised position it provides a barrier to contamination of the food products by customers at the front customer side of the product server while allowing access to said food products by employees at the rear employee side of the product server, upright frame members extending up from the cabinet at spaced-apart locations along the front customer side of the product server, and an open area extending between the upright frame members along the front customer side of the product server, said open area being unobstructed with respect to said customers when the breath guard panel is in its lowered position and obstructed only by the breath guard panel with respect to said customers at the front customer side of the product server when the breath guard panel is in its raised position whereby the breath guard panel in its raised position functions to prevent said contamination that could otherwise occur through the open area.

27. The product server of claim 26, further comprising an upper frame member extending between the upright frame members above the open area.

28. The product server of claim 27, wherein the upper frame member comprises a shelf.

29. The product server of claim 26, further comprising upright side panels affixed to the upright frame members.

30. The product server of claim 28, wherein the upright side panels are transparent.

31. The product server of claim 26, wherein said upright frame members are located generally adjacent opposite ends of the cabinet.

* * * * *